United States Patent [19]

Kitagawa et al.

[11] 4,192,263

[45] Mar. 11, 1980

[54] VALVE DRIVE DEVICE FOR AN INTERNAL COMBUSTION ENGINE

[75] Inventors: Katsutoshi Kitagawa, Seto; Hiroki Yamauchi, Kariya, both of Japan

[73] Assignee: Toyota Jidosha Kogyo Kabushiki Kaisha, Toyota, Japan

[21] Appl. No.: 818,748

[22] Filed: Jul. 26, 1977

[30] Foreign Application Priority Data

Jul. 27, 1976 [JP] Japan ..... 51-89551

[51] Int. Cl.[2] ..... F01L 1/18

[52] U.S. Cl. ..... 123/90.39; 123/90.36; 123/90.46; 123/90.44; 74/519

[58] Field of Search ..... 123/90.46, 90.45, 90.44, 123/90.36, 90.47, 90.39, 90.59; 74/519, 559

[56] References Cited

U.S. PATENT DOCUMENTS

| | | | |
|---|---|---|---|
| 1,691,991 | 11/1928 | Puckett | 123/90.44 |
| 1,994,743 | 3/1935 | Anderson | 123/90.47 |
| 2,011,863 | 8/1935 | Lovett | 123/90.47 |
| 2,036,936 | 4/1936 | Halford | 123/90.46 |
| 2,764,141 | 9/1956 | Schoonover | 123/90.47 |
| 2,818,845 | 1/1958 | Yandt | 123/90.46 |

FOREIGN PATENT DOCUMENTS

| | | | |
|---|---|---|---|
| 2039975 | 2/1972 | Fed. Rep. of Germany | 123/90.46 |

*Primary Examiner*—Ira S. Lazarus
*Assistant Examiner*—Jeffrey L. Yates
*Attorney, Agent, or Firm*—Oblon, Fisher, Spivak, McClelland & Maier

[57] ABSTRACT

A valve drive device for an internal combustion engine characterized in a movably pivoted rocker arm, at either a cam-contacting part or a valve stem-contacting part thereof, having installed therein a built-in oil pressure tappet for automatically absorbing a gap created at such contacting part. Between the oil pressure tappet and the cam or the valve stem, in contact with the oil pressure tappet, a movable plate is provided, having a curved surface where the movable plate and/or the oil pressure tappet contact each other, thereby lubricating the contacting part to prevent its abrasion.

1 Claim, 6 Drawing Figures

VALVE DRIVE DEVICE FOR AN INTERNAL COMBUSTION ENGINE

BACKGROUND OF THE INVENTION

1. Field of the Invention

The present invention relates generally to a valve drive device for an internal combustion engine, and more specifically to a valve drive device in which an oil pressure tappet, for automatically absorbing a gap created in a valve drive system, is built into a rocker arm, thereby preventing the wear of the contacting part of the oil pressure tappet exposed to heavy abrasion.

2. Description of the Prior Art

In a valve drive device in which a rocker arm is movably pivoted, one end thereof bearing the cam load and the other end thereof driving the valve stem, expansion and contraction of the valve stem due to the valve heat and wear of the valve seat cause a gap to be created between the valve drive transmitting parts. This gap, being liable to disturb the exhaust timing or to shorten the engine life, should be eliminated. It has been considered unwise to install an oil pressure tappet in the rocker arm, which is hydraulically moved to protrude or withdraw for the purpose of eliminating the gap, because it increases the moving weight and thereby decreases the maximum number of revolutions or results in the decrease of durability. If, however, the oil pressure tappet can be reduced in weight, it is desirable that the oil pressure tappet be built into the rocker arm since the whole valve drive device can then be simplified. This will also be desirable in that a gap-absorbing mechanism can be additionally obtained without any major design modification of the conventional overhead cam type drive mechanism.

For the purpose of building an oil pressure tappet into either the cam-contacting part or the valve stem-contacting part of the rocker arm and making the oil pressure tappet smaller, it is conceivable to insert a movable plate between the oil pressure tappet and the cam or the valve stem in contact therewith so that the frictional force acting on the oil pressure tappet from the cam or the valve stem in a direction normal to the central axis of the oil pressure tappet can be borne by the movable plate, thereby lessening the side thrust acting on the oil pressure tappet and shortening the required length of the oil pressure tappet. Smooth action and sufficient durability of a valve drive device with such an inserted movable plate depend on whether or not the slide-contacting part of the oil pressure tappet and the movable plate exposed to heavy abrasion with each other can be protected from seizure, wear and other damage.

SUMMARY OF THE INVENTION

A primary object of the present invention therefore is to provide a valve drive device for an internal combustion engine in which the slide-contacting part of a movable plate and the oil pressure tappet are protected from seizure, wear and other damage.

Another object of the present invention is to provide a valve drive device for an internal combustion engine in which the slide-contacting parts of the movable plate and the oil pressure tappet are lubricated, thereby protecting such parts from seizure, wear and other damage.

Still another object of the present invention is to provide a valve drive device for an internal combustion engine characterized in the smoothness of action and durability of the device being substantially improved by prevention of seizure, wear and other damage in the slide-contacting parts of the movable plate and the oil pressure tappet.

Still another object of the present invention is to provide a valve drive device for an internal combustion engine in which the movable range of the movable plate in such a device, with the slide-contacting part of the movable plate and the oil pressure tappet protected from damage, is so restricted that the oil pressure tappet can be prevented from dropping out, thereby facilitating the handling of the device.

BRIEF DESCRIPTION OF THE DRAWINGS

Various other objects, features and attendant advantages of the present invention will be more fully appreciated as the same becomes better understood from the following detailed description when considered in conjunction with the accompanying drawings, in which like reference characters designate like or corresponding parts in the several views and wherein.

DETAILED DESCRIPTION OF THE PREFERRED EMBODIMENTS

Figure 1:
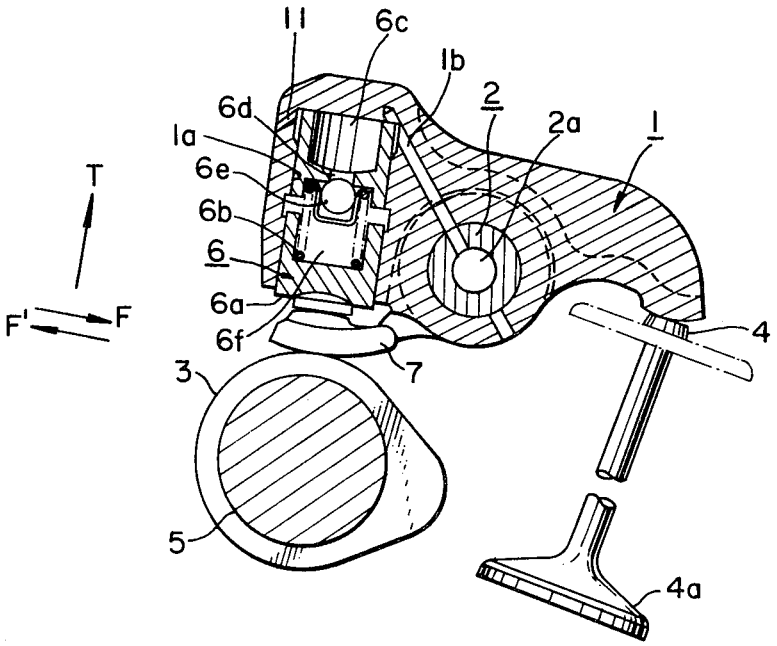
FIG. 1 is a sectional view of one embodiment of the present invention in which the oil pressure tappet is built into the cam side of the rocker arm.
Figure 2:
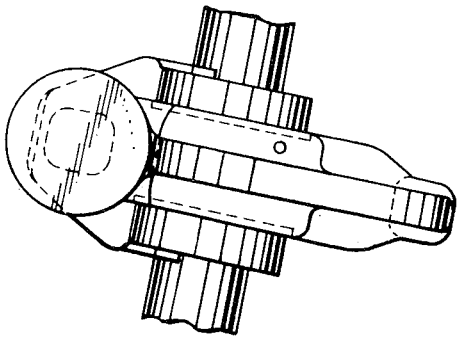
FIG. 2 is a partial plan view of the rocker arm shown in FIG. 1.

In FIGS. 1 and 2, illustrating an embodiment of the present invention in which the oil pressure tappet is built into the cam side of the rocker arm, a rocker arm 1 is pivotably mounted on a rocker arm shaft 2, one end of the rocker arm bearing the load of a cam 3 and the other end thereof driving a valve stem 4. The cam 3, which rotates together with a camshaft 5, is rotatably interlocked with the crankshaft of the engine. On the engine insert side of the valve stem 4 is provided a valve **4*a* to open and close the gap path, such valve being opened and closed by vertically driving the valve stem 4. At the part of the rocker arm 1 where it contacts the cam 3, an oil pressure tappet 6 is built in. The oil pressure tappet 6 consists of a lifter 6*a* which is movably disposed within a hole 1*a* formed in the rocker arm 1, a spring 6*b* within the lifter and urging the lifter 6*a* to protrude from the hole toward the cam 3, a hole 6*d* through which oil flows into an oil chamber 6*f* formed within the hole 1*a* by lifter 6*a* when the lifter 6*a* is moved outward by the force of the spring 6*b*, and a check ball 6*e* which is provided at the hole 6*d* to prevent the oil from flowing back. An oil chamber 6*c*, which communicates via a path 1*b* with an oil supply path 2*a* provided in the rocker arm shaft 2, is always filled with oil. When a gap is created between the rocker arm 1 and the valve stem 4 or the cam 3, the lifter 6*a*, urged by the spring 6*b***, moves and closes the gap and, at the same time, the oil flows from the chamber 6c into the chamber 6f through the hole 6d. The oil which has flowed in is prevented from backflow by the check ball 6e, thereby preventing the lifter 6a from being pushed in by the oil in the chamber 6f and thus preventing a gap from being created.

Figure 3:
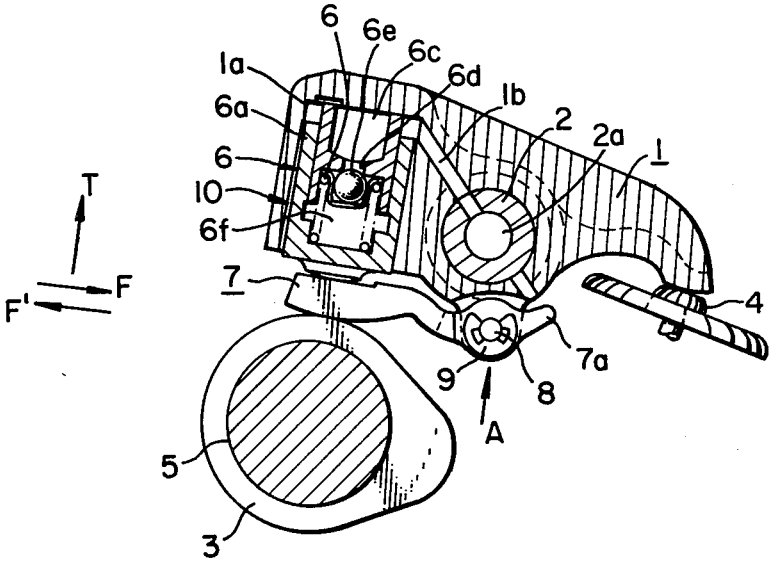
FIG. 3 is a sectional view of the device shown in FIG. 1 in which the movable plate is pivoted to the rocker arm and the underside of the oil pressure tappet is curved.

Between the oil pressure tappet 6 and the valve stem 4 or the cam 3, there is inserted a movable plate 7, which is pivotably mounted on the rocker arm shaft 2. In FIG. 1, the movable plate 7 is pivoted to the rocker arm shaft 2, but as shown in FIG. 3, it may be supported on a pin 8 fixed to the rocker arm 1. The movable plate 7 shares the frictional forces F, F' to which the rocker arm 1 is subjected in upward contact with the cam 3 or the valve stem 4 and thereby causes only the axial force T to fall on the lifter 6a. Thus, an opening force is prevented from acting on the oil pressure tappet 6, thereby shortening the axial length of the oil pressure tappet.

Referring to FIG. 3, on the movable plate 7, at a position opposite the part thereof contacting the oil pressure tappet 6, across the pivotal point 8, there is provided a projection 7a. When the movable plate 7 revolves through a specific angle around the pivotal point, this projection 7a hits the rocker arm 1 and prohibits further rotation of the movable plate 7, thereby preventing the lifter 6a from slipping out of the hole 1a.

Figure 4:
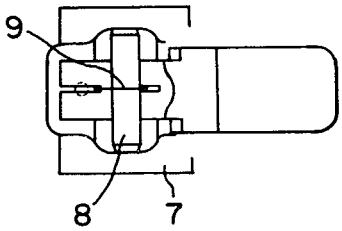
FIG. 4 is a view of a part close to the support of the movable plate, taken along the arrow A in FIG. 3.

When, as illustrated in FIG. 3, the movable plate 7 is pinned to the rocker arm 1, the pin 8, as illustrated in FIG. 4, is supported by means of an E-ring 9 at one central point of the movable plate 7, thereby locking the pin 8 against slip-out.

Figure 5:
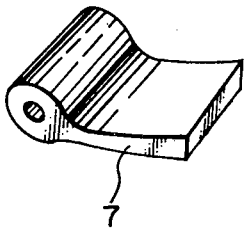
FIG. 5 is an oblique view of the movable plate whose top surface is finished cylindrical.

Smoothness of the contact between the movable plate 7 and the oil pressure tappet 6 can be secured by giving a curved surface to the top of the movable plate 7 and/or the underside of the lifter 6a. In FIG. 1, the underside of the lifter 6a is made flat, while the top of the movable plate 7 is curved. In FIG. 3 the underside of the lifter 6a is curved, while the top of the movable plate 7 is made flat. The curved surface is not necessarily spherical, but it can be, for example, cylindrical, if a lop-sided contact can be prevented. FIG. 5 illustrates an example of the top surface of the movable plate 7 being made cylindrical, in which a linear contact can be established between the movable plate 7 and the lifter 6a, thereby improving the wear resistance.

To lubricate the contacting part between the movable plate 7 and the oil pressure tappet 6 and the contacting part between the movable plate and the cam 3 or the valve stem 4a, there is provided a means for diverting a part of the pressurized oil for driving the oil pressure tappet 6 to the contacting part. In the example of FIG. 3, a groove 10 leading from the bottom end of the lifter hole 1a to the upper oil chamber 6c serves as a lubricating means. This groove 10 is provided on the inside surface of the lifter hole 1a, when it is desirable that the direction of lubrication be constant, and it may be provided on the cylindrical surface of the lifter 6a, when such direction need not be constant. In the example of FIG. 1, an orifice 11 runs through the wall of the rocker arm 1 from the oil chamber 6c, whereby the adjoining rocker arm 1 and the movable plate 7 are lubricated.

In the valve drive device thus constituted, with the movement of the rocker arm 1, a sliding occurs between the movable plate 7 and the oil pressure tappet 6 and between the movable plate 7 and the cam 3 or the valve stem 4, and the contacting surface can be well lubricated with the oil which is always supplied through the groove 10 or the orifice 11 from the oil pressure tappet 6.

Figure 6:
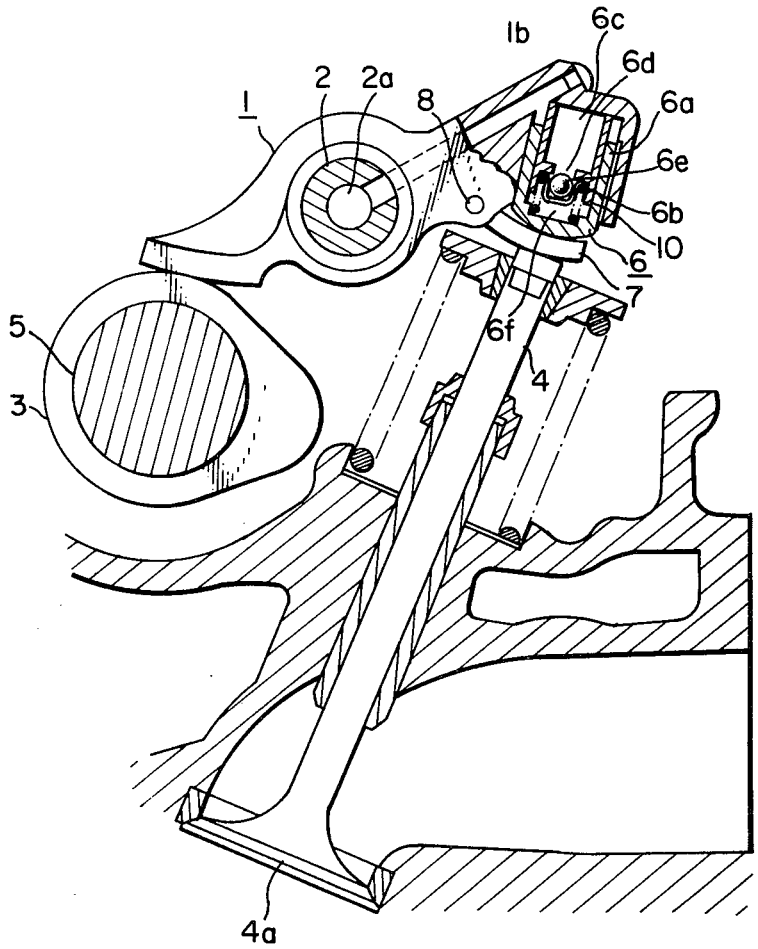
FIG. 6 is a sectional view of a modified device in which the oil pressure tappet is built into the valve stem side of the rocker arm.

FIG. 6 illustrates a different embodiment from the one shown in FIGS. 1 and 3, in which the oil pressure tappet is built into the valve stem side of the rocker arm. A detailed account of this embodiment is omitted, because this embodiment is the same in constitution and function as the one described in FIGS. 1 and 3, except for the installation of the oil pressure tappet on the valve stem side of the rocker arm instead of on the cam side, and accordingly the insertion of the movable plate 7 between the oil pressure tappet and the valve stem.

In the valve drive device for an internal combustion engine according to the present invention in which a small, light oil pressure tappet, with a movable plate inserted therein, is built into the rocker arm, and the part contacting with the movable plate and/or the part contacting the oil pressure tappet has a curved surface, a smooth sliding contact can be secured, and a well-lubricated condition can be maintained by a lubricating means which supplies the oil from the oil pressure tappet to the contacting surface. Thus, the troubles in the installation of the movable plate, such as seizure, wear and other damage to its contacting part, can be eliminated, thereby ensuring the smooth operation of the valve drive device with a built-in oil pressure tappet.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A valve device for an internal combustion engine comprising:

a cam;

a valve stem;

a pivotable mounted rocker arm, one end of said rocker arm having a part contacting said cam and the other end having a part contacting said valve stem;

an oil pressure tappet built into one of said contacting parts to automatically absorb a gap created between one of said contacting parts and said cam or said valve stem;

a movable plate inserted between said oil pressure tappet and one of said cam or said valve stem, being in contact with said oil pressure tappet;

a projection provided on said movable plate at a position opposed to the contacting part of said oil pressure tappet across the pivotal port thereof, which serves to prevent said oil pressure tappet from dropping out of said rocker arm before said rocker arm is set in an internal combustion engine, and hits said rocker arm when said movable plate revolves around said pivotal point, thereby regulating the revolving angle to a specified range;

a curve means formed at the contacting part between said oil pressure tappet and said movable plate; and means for lubricating the contacting part between said oil pressure tappet and said movable plate.

* * * * *